US006575080B1

(12) United States Patent
Enokijima et al.

(10) Patent No.: US 6,575,080 B1
(45) Date of Patent: Jun. 10, 2003

(54) SINGLE-HEADED PISTON FOR SWASH PLATE TYPE COMPRESSOR WHEREIN HEAD PORTION HAS A CURVED SURFACE AT AXIAL END

(75) Inventors: Fuminobu Enokijima, Kariya (JP); Takahiro Hoshida, Kariya (JP); Seiji Katayama, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 59 days.

(21) Appl. No.: 09/667,949

(22) Filed: Sep. 22, 2000

(30) Foreign Application Priority Data

Sep. 24, 1999 (JP) ..... 11-270355

(51) Int. Cl.[7] ..... F01B 3/00; F16J 1/00
(52) U.S. Cl. ..... 92/71; 92/172
(58) Field of Search ..... 92/71, 172

(56) References Cited

U.S. PATENT DOCUMENTS

| | | | | |
|---|---|---|---|---|
| 4,191,095 A | | 3/1980 | Heyl | 92/78 |
| 5,265,331 A | | 11/1993 | Engel et al. | 29/888.044 |
| 5,630,353 A | | 5/1997 | Mittlefehldt et al. | 92/71 |
| 5,970,845 A | * | 10/1999 | Beck | 92/71 |
| 6,010,313 A | * | 1/2000 | Kimura et al. | 92/71 |

FOREIGN PATENT DOCUMENTS

| | | |
|---|---|---|
| EP | 0 864 787 A2 | 9/1998 |
| JP | 0 740 076 A2 | 10/1996 |
| JP | A-9-105380 | 4/1997 |
| JP | A-9-177670 | 7/1997 |
| JP | 10 159 725 A | 6/1998 |

OTHER PUBLICATIONS

EP 00 12 0162 Search Report dated May 29, 2002.

* cited by examiner

*Primary Examiner*—Edward K. Look
*Assistant Examiner*—Michael Leslie
(74) *Attorney, Agent, or Firm*—Woodcock Washburn LLP

(57) ABSTRACT

A single-headed piston for a swash plate type compressor including a head portion having an outer circumferential surface for sliding contact with an inner circumferential surface of a cylinder bore formed in a cylinder block of the compressor, and an engaging portion engaging a swash plate of the compressor, characterized in that; the outer circumferential surface of the head portion includes a cylindrical surface and a curved surface which is formed adjacent to at least one of opposite axial ends of the cylindrical surface, so as to smoothly extend from at least one circumferential part of the cylindrical surface, the curved surface being formed such that a radial distance between a centerline of the cylindrical surface and the curved surface gradually decreases in an axial direction of the cylindrical surface from the corresponding axial end of the cylindrical surface toward the corresponding axial end of the piston, and such that a radius of curvature of a cross sectional shape of the curved surface taken in a plane which includes the centerline of the cylindrical surface is larger than a diameter of the inner circumferential surface of the cylinder bore.

12 Claims, 6 Drawing Sheets

SINGLE-HEADED PISTON FOR SWASH PLATE TYPE COMPRESSOR WHEREIN HEAD PORTION HAS A CURVED SURFACE AT AXIAL END

This application is based on Japanese Patent Application No. 11-270355 filed Sep. 24, 1999, the contents of which are incorporated hereinto by reference.

BACKGROUND OF THE INVENTION

1. Field of the Invention

The present invention relates in general to a method of producing a body member for a piston for a awash plate type compressor, and more particularly to a method of producing, by die-casting, such a body member having a hollow cylindrical head portion.

2. Discussion of the Related Art

A swash plate type compressor is adapted to compress a gas by a plurality of pistons which are reciprocated by a rotary movement of a swash plate. In general, the piston includes a head portion slidably fitted in a cylinder bore formed in a cylinder block of the compressor, and an engaging portion which sidably engages the swash plate. For reducing the weight of the piston, it has been proposed to form the piston with a hollow cylindrical head section. As one example of the method of producing such a piston, the assignee of the present invention proposed in JP-A-11-152239 a method of producing a blank for the piston, comprising the steps of preparing a body member including a hollow head section which is closed at one of its opposite ends and is open at the other end, and an engaging section which is formed integrally with the head section; and fixing a closing member prepared separately from the body member, to the body member so as to close the open end of the head section. While the closing member may be produced by any method, the body member is preferably produced by die-casting.

SUMMARY OF THE INVENTION

The present invention was made in the light of the background art described above. It is an object of the present invention to provide a single-headed piston for a swash plate type compressor, which has a reduced operating noise.

The object indicated above may be achieved according to any one of the following forms or modes of the present invention, each of which is numbered like the appended claims and depend from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) A single-headed piston for a swash plate type compressor including a head portion having an outer circumferential surface for sliding contact with an inner circumferential surface of a cylinder bore formed in a cylinder block of the compressor, and an engaging portion engaging a swash plate of the compressor, characterized in that: the outer circumferential surface of the head portion includes a cylindrical surface and a curved surface which is formed adjacent to at least one of opposite axial ends of the cylindrical surface, so as to smoothly extend from at least one circumferential part of the cylindrical surface, the curved surface being formed such that a radial distance between a centerline of the cylindrical surface and the curved surface gradually decreases in an axial direction of the cylindrical surface from the corresponding axial end of the cylindrical surface toward the corresponding axial end of the piston, and such that a radius of curvature of a cross sectional shape of the curved surface taken in a plane which includes the centerline of the cylindrical surface is larger than a diameter of the inner circumferential surface of the cylinder bore.

The curved surface formed adjacent to at least one of axially opposite ends of the cylindrical surface of the head portion of the single-headed piston is effective to reduce the noise generated by the awash plate type compressor during its operation. The presence of the curved surface permits the head portion of the piston to smoothly slide on the inner circumferential surface of the cylinder bore.

(2) A single-headed piston according to the above mode (1), the curved surface is formed at at least one of an axial end of the cylindrical surface nearer to the engaging portion so as to extend from a first circumferential part of the cylindrical surface which is nearer to an axis of rotation of the swash plate, and an axial end of the cylindrical surface remote from the engaging portion so as to extend from a second circumferential part of the cylindrical surface which is more distant from the axis of rotation of the swash plate than the first circumferential part.

The above-indicated first and second circumferential parts of the cylindrical surface of the head portion of the piston generally suffer from a particularly large contacting surface pressure when the head portion of the piston contacts the inner circumferential surface of the cylinder bore during operation of the swash plate type compressor. By forming the curved surfaces in these circumferential parts, the piston can be smoothly reciprocated within the cylinder bore.

(3) A single-headed piston according to the above mode (2), wherein the curved surface is formed at the axial end of the cylindrical surface which is remote from the engaging portion and extends over an entire circumference of the cylindrical surface.

It is confirmed that the curved surface formed at the axial end of the head portion of the piston which is remote from the engaging portion is particularly advantageous. In general, the axial end face of the head portion remote from the engaging portion has a simple circular configuration. Since the cylindrical surface and the circular end face intersect each other so as to define a simple circle, it is easy to form the curved surface which extends over the entire circumference of the cylindrical surface of the head portion at the axial end which is remote from the engaging portion.

(4) A single-headed piston according to the above mode (2) or (3), wherein the curved surface is formed at one of opposite axial ends of the head portion which is nearer to the engaging portion and extends over an entire circumference of the axial end of the head portion.

Where the single-headed piston has a hollow cylindrical head portion, the axial end of the outer circumferential surface of the head portion which is nearer to the engaging portion has a simple circular shape. Accordingly, it is easy to form the curved surface which extends over the entire circumference of the outer circumferential surface at that axial end. However, the curved surface which extends over the entire circumference of the outer circumferential surface may be formed at that axial end portion whose configuration is not a simple circle.

(5) A single-headed piston according to any one of the above modes (1)–(4), wherein the cross sectional shape of the curved surface taken in the plane which includes the centerline of the cylindrical surface is an arc.

The cross sectional shape of the curved surface may be suitably determined, provided it has a smooth convex curve. For instance, the cross sectional shape of the curved surface may be a plurality of arcs having respective different radii of curvature, an ellipse, or a part of a hyperbola. If the cross sectional shape of the curved surface is a simple arc, the piston can be economically manufactured.

(6) A single-headed piston according to any one of the above modes (1)–(5), wherein a dimension r1 between a surface of extension of the cylindrical surface and a straight line which is parallel to the surface of extension and which passes one of opposite ends of the curved surface which is remote from the cylindrical surface is not greater than 15 μm.

When the dimension r1 is excessively large, the lubricant oil adhering to the inner circumferential surface of the cylinder bore is less likely to be introduced into a wedge-shaped gap which is formed between the inner circumferential surface of the cylinder bore and the outer circumferential surface of the head portion of the piston. In this case, the effect of the formed curved surface is reduced. In view of this, the above-indicated dimension r1 is generally not greater than 15 μm, preferably not greater than 10 μm, and more preferably not greater than 5 μm. On the contrary, if the dimension r1 is excessively small, the lubricant oil is less likely to be introduced into the wedge-shaped gap. Accordingly, the dimension r1 is preferably not smaller than 1 μm, and more preferably not smaller than 2 μm.

(7) A single-headed piston according to any one of the above modes (1)–(6), wherein a quotient obtained by dividing a dimension r1 between a surface of extension of the cylindrical surface and the straight line which is parallel to the surface of extension and which passes one of opposite ends of the curved surface which is remote from the cylindrical surface, by an axial dimension l1 of the curved surface as measured in a direction parallel to the centerline of the cylindrical surface, is substantially equal to a quotient obtained by dividing a clearance r2 between the outer circumferential surface of the head portion of the piston and the inner circumferential surface of the cylinder bore when the piston is fitted in the cylinder bore, by an axial dimension l2 of the cylindrical surface, the clearance r2 being a difference between a diameter of the outer circumferential surface of the head portion and a diameter of the inner circumferential surface of the cylinder bore.

When the piston is inclined within the cylinder bore due to a side force which is applied from the swash plate to the piston in a direction perpendicular to its centerline, an intermediate portion of the curved surface of the head portion as seen in a direction parallel to the centerline of the cylindrical surface contacts the inner circumferential surface of the cylinder bore. Accordingly, the present arrangement assures a smooth sliding of the outer circumferential surface of the head portion of the piston on the inner circumferential surface of the cylinder bore. The above-indicated axial dimension l2 of the cylindrical surface is an axial distance between a boundary of the cylindrical surface and the curved surface which contacts the inner circumferential surface of the cylinder bore when the piston is inclined within the cylinder bore due to the above-indicated side force, and one of opposite axial ends of the cylindrical surface which is spaced from the above-indicated boundary in the diametric direction of the head portion of the piston and which is remote from the boundary in the axial direction of the head portion. The angle of inclination of the head portion of the piston is determined depending upon the axial dimension l2 of the cylindrical surface of the head portion and the clearance between the outer circumferential surface of the head portion of the piston and the inner circumferential surface of the cylinder bore when the head portion of the piston is fitted in the cylinder bore. This clearance will be hereinafter referred to as a "fitting clearance". Further, the angle of inclination of the head portion of the piston within the cylinder bore determined as described above determines the manner in which the curved surface contacts the inner circumferential surface of the cylinder bore. In essence, the axial dimension l2 of the cylindrical surface is determined such that a wedge-shaped gap, which has a suitable size for facilitating introduction of the lubricant oil thereinto, is formed between the curved surface and the inner circumferential surface of the cylinder bore when the head portion of the piston is inclined in the cylinder bore.

As described above, the axial dimension l2 of the cylindrical surface determines the angle of inclination of the head portion of the piston in the cylinder bore. Even when the cylindrical surface has an opening or openings or is not continuously formed between its opposite axial ends, the axial dimension l2 of the cylindrical surface is an axial distance between the opposite axial ends.

(8) A single-headed piston according to any one of the above modes (1)–(7), wherein the axial dimension l1 of the curved surface which is parallel to its centerline is not larger than ⅕ of the axial dimension l2 of the cylindrical surface.

The axial dimension l2 of the cylindrical surface decreases and the angle of inclination of the head portion within the cylinder bore increases with an increase of the axial dimension l1 of the curved surface. Accordingly, it is not desirable that the axial dimension l1 of the curved surface is too large. In view of this, the axial dimension l1 of the curved surface is preferably not larger than ⅕, not larger than ⅛, or not larger than 1/15 of the axial dimension l2 of the cylindrical surface. It is not desirable, however, that the axial dimension l1 of the curved surface is too small. In view of this, the axial dimension l1 of the curved surface is preferably not smaller than 1/100 of the axial dimension l2 of the cylindrical surface.

(9) A single-headed piston according to any one of the above modes (1)–(8), wherein the outer circumferential surface of the head portion includes a tapered surface which smoothly extends from one of opposite ends of the curved surface which is remote from the cylindrical surface such that the tapered surface has a diameter which gradually and linearly reduces in an axial direction of the cylindrical surface from the curved surface toward the corresponding axial end of the piston, the tapered surface being formed such that a difference between a radius of its large-diameter end and a radius of its small-diameter end is selected within a range between 1 μm and 15 μm.

The tapered surface cooperates with the curved surface to define the wedge-shaped gap which facilitates introduction of the lubricant oil thereinto. Accordingly, the taper angle of the tapered surface is considerably smaller than that of a chamfer formed adjacent to the tapered surface. Accordingly, the tapered surface is formed such that the difference between the radius of the large-diameter end and the radius of the small-diameter end, in other words, a half of a difference between a diameter D1 of the large-diameter end a diameter D2 of the small-diameter end, is generally in a range between 1 μm and 15 μm, and more preferably in a range between 2 μm and 5 μm.

(10) A single-headed piston for a swash plate type compressor including a head portion having an outer circumferential surface for sliding contact with an inner circumferential surface of a cylinder bore formed in a cylinder block of the compressor, and an engaging portion engaging a swash plate of the compressor, characterized in that: the outer circumferential surface of the head portion includes a cylindrical surface, and a tapered surface which is formed adjacent to at least one of axially opposite ends of the cylindrical surface so as to extend from at least one circumferential part of the cylindrical surface, the tapered surface being formed such that a difference between a radius of its large-diameter end and a radius of its small-diameter end is selected within a range between 1 $\mu$m and 15 $\mu$m.

The tapered surface which is formed adjacent to at least one of opposite ends of the cylindrical surface of the head portion of the piston is effective to reduce the noise of the compressor during its operation since the head portion of the piston smoothly slides within the cylinder bore owing to the tapered surface. The reduction of the operating noise of the compressor is achieved even when an area of boundary between the tapered surface and the cylindrical surface is not substantially rounded, as well as when the area of boundary is substantially rounded. This is because an angle between the tapered surface and the cylindrical surface is considerably close to 180°. Further, the introduction of the lubricant oil into the wedge-shaped gap formed between the tapered surface and the inner circumferential surface of the cylinder bore prevents contact of a line of intersection of the tapered surface and the cylindrical surface, with the inner circumferential surface of the cylinder bore, or reduces the contacting surface pressure between the tapered surface and the cylindrical surface.

(11) A single-headed piston according to any one of the above modes (1)–(10), wherein the head portion of the piston has a hollow cylindrical shape.

When the head portion of the piston has a hollow cylindrical shape, the weight of the piston can be easily reduced, resulting in reduction of the operating noise of the compressor. Further, the curved surface can be easily formed over the entire circumference at each of the opposite ends of the cylindrical surface, since the hollow cylindrical head portion has at its opposite axial ends a simple circular shape in transverse cross section.

(12) A single-headed piston according to any one of the above modes (1)–(10), wherein the head portion of the piston includes a sealing section having a circular cross sectional shape, and two auxiliary sliding surfaces which are located between the engaging portion of the piston and the sealing section and which consist of an inner auxiliary sliding surface which is nearer to an axis of rotation of the swash plate, and an outer auxiliary sliding surface which is remote from the axis of rotation of the swash plate, the two auxiliary sliding surfaces are flush with an outer circumferential surface of the sealing section.

In the piston according to this arrangement, the auxiliary sliding surfaces cooperate with the outer circumferential surface of the sealing section to form the outer circumferential surface of the head portion of the piston. Accordingly, when the curved surface is formed at one of opposite ends of the outer circumferential surface of the head portion on the side of the engaging portion, the curved surface is formed at one of opposite ends of each of the auxiliary sliding surfaces, which is located on the side of the engaging portion.

(13) A swash plate type compressor comprising: a housing having a plurality of cylinder bores, a rotary drive shaft which is rotatably supported by the housing, a swash plate which is prevented from rotating relative to the rotary drive shaft and which is inclined with respect to an axis of the rotary drive shaft; and a piston including a head portion slidably fitted in each of the cylinder bores, and an engaging portion slidably engaging the swash plate through a pair of shoes which are held in contact with opposite surfaces of the swash plate at a radially outer portion of the swash plate, and wherein the piston has a structure as defined in any one of the above modes (1)–(12).

(14) A swash plate type compressor according to the above mode (14), further comprising a swash plate angle adjusting device for adjusting an angle of inclination of the swash plate with respect to the axis of the rotary drive shaft.

A swash plate type compressor wherein the angle of inclination of the swash plate is variable, in particular, a variable capacity type swash plate compressor having the above-indicated swash plate angle adjusting device which is adapted to control the inclination angle of the swash plate by controlling the pressure in the crank chamber, suffers from a serious problem of the operating noise. The piston constructed according to the present invention described above is effective to solve such a problem when applied to the above-described variable capacity type awash plate compressor having the inclination angle adjusting device.

BRIEF DESCRIPTION OF THE DRAWINGS

The above and optional objects, features, advantages and technical and industrial significance of the present invention will be better understood and appreciated by reading the following detailed description of presently preferred embodiments of the invention, when considered in connection with the accompanying drawings, in which.

DETAILED DESCRIPTION OF THE PREFERRED EMBODIMENTS

Referring to the accompanying drawings, there will be described presently preferred embodiments of the present invention as applied to a single-headed piston for a swash plate type compressor used for an air conditioning system of an automotive vehicle.

Figure 1:
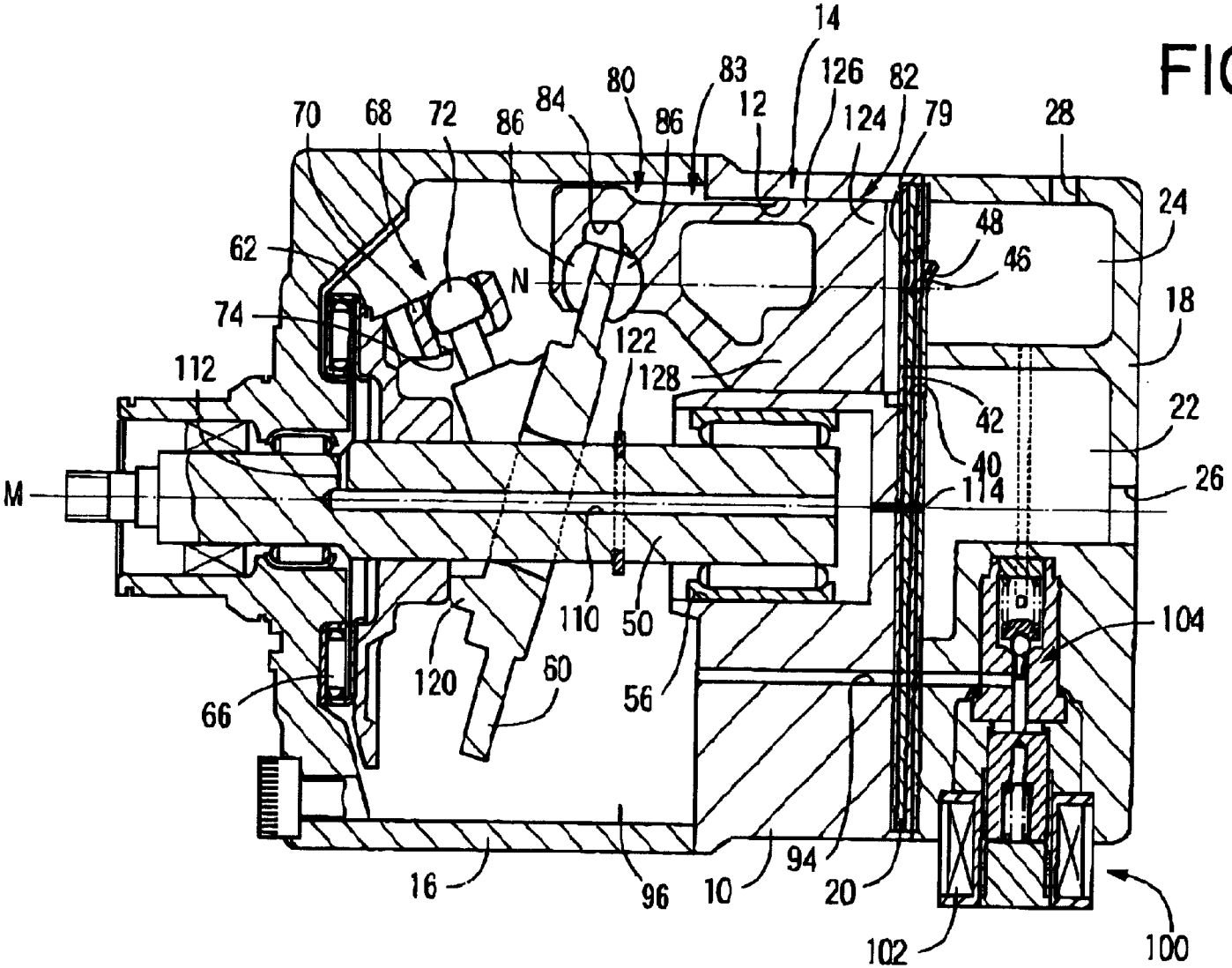
FIG. 1 is a front elevational view in cross section of a swash plate type compressor equipped with a single-headed piston constructed according to one embodiment of the present invention.

Referring first to FIG. 1, there is shown a compressor of swash plate type incorporating a plurality of single-headed pistons (hereinafter referred to simply as "pistons") each constructed according to one embodiment of the present invention.

In FIG. 1, reference numeral 10 denotes a cylinder block having a plurality of cylinder bores 12 formed so as to extend in its axial direction such that the cylinder bores 12 are arranged along a circle whose center lies on a centerline M of the cylinder block 10. The piston generally indicated at 14 is reciprocably received in each of the cylinder bores 12. To one of the axially opposite end faces of the cylinder block 10, (the left end face as seen in FIG. 1, which will be referred to as "front end face"), there is attached a front housing 16. To the other end face (the right end face as seen in FIG. 1, which will be referred to as "rear end face"), there is attached a rear housing 18 through a valve plate 20. The front housing 16, rear housing 18 and cylinder block 10 cooperate to constitute a housing assembly of the swash plate type compressor.

The rear housing 18 and the valve plate 20 cooperate to define a suction chamber 22 and a discharge chamber 24, which are connected to a refrigerating circuit (not shown) through an inlet 26 and an outlet 28, respectively. The valve plate 20 has suction ports 40, suction valves 42, discharge ports 46 and discharge valves 48.

A rotary drive shaft 50 is disposed in the cylinder block 10 and the front housing 16 such that the axis of rotation of the drive shaft 50 is aligned with the centerline M of the cylinder block 10. The drive shaft 50 is supported at its opposite end portions by the front housing 16 and the cylinder block 10, respectively, via respective bearings. The cylinder block 10 has a central bearing hole 56 formed in a central portion thereof, and the bearing is disposed in this central bearing hole 56, for supporting the drive shaft 50 at its rear end portion. The front end portion of the drive shaft 50 is connected, through a clutch mechanism such as an electromagnetic clutch, to an external drive source (not shown) in the form of an engine of an automotive vehicle. In operation of the compressor, the drive shaft 50 is connected through the clutch mechanism to the vehicle engine in operation so that the drive shaft 50 is rotated about its axis.

The rotary drive shaft 50 carries a swash plate 60 such that the swash plate 60 is axially movable and tiltable relative to the drive shaft 50. To the drive shaft 50, there is fixed a rotary member 62 as a torque transmitting member, which is held in engagement with the front housing 16 through a thrust bearing 66. The swash plate 60 is rotated with the drive shaft 50 by a hinge mechanism 68 during rotation of the drive shaft 50 The hinge mechanism 68 guides the swash plate 60 for its axial and tilting motions. The hinge mechanism 68 includes a pair of support arms 70 fixed to the rotary member 62, guide pins 72 which are formed on the swash plate 60 and which slidably engage guide holes 74 formed in the support arms 70.

The piston 14 indicated above includes as an engaging portion in the form of a neck portion 80 engaging the swash plate 60, a head portion 82 fitted in the corresponding cylinder bore 12, and a connecting portion 83 which connects the neck portion 80 and the head portion 82. The neck portion 80 has a groove 84 formed therein, and the swash plate 60 is held in engagement with the groove 84 through a pair of hemispherical shoes 86. The hemispherical shoes 86 are held in the groove 84 such that the shoes 86 slidably engage the neck portion 80 at their hemispherical surfaces and such that the shoes 86 slidably engage the radially outer portions of the opposite surfaces of the swash plate 60 at their flat surfaces. The configuration of the piston 14 will be described in detail.

A rotary motion of the swash plate 60 is converted into a reciprocating linear motion of the piston 14 through the shoes 86. A refrigerant gas in the suction chamber 22 is sucked into the pressurizing chamber 79 through the suction port 40 and the suction valve 42, when the piston 14 is moved from its upper dead point to its lower dead point, that is, when the piston 14 is in the suction stroke. The refrigerant gas in the pressurizing chamber 79 is pressurized by the piston 14 when the piston 14 is moved from its lower dead point to its upper dead point, that is, when the piston 14 is in the compression stroke. The pressurized refrigerant gas is discharged into the discharge chamber 24 through the discharge port 46 and the discharge valve 48. A reaction force acts on the piston 14 in the axial direction as a result of compression of the refrigerant gas in the pressurizing chamber 79. This compression reaction force is received by the front housing 16 through the piston 14, swash plate 60, rotary member 62 and thrust bearing 66.

Figure 2:
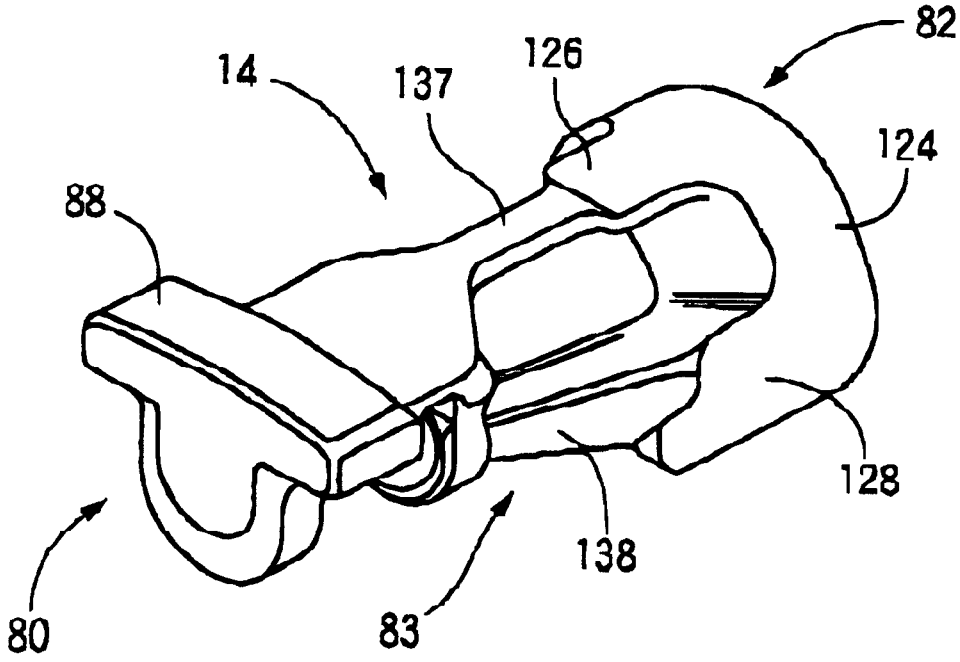
FIG. 2 is a perspective view of a single-headed piston included in the swash plate type compressor of FIG. 1.

As shown in FIG. 2, the neck portion 80 of the piston 14 has an integrally formed rotation preventive part 88, which is arranged to contact the inner circumferential surface of the front housing 16, for thereby preventing a rotary motion of the piston 14 about its centerline N.

The cylinder block 10 has a supply passage 94 formed therethrough for communication between the discharge chamber 24 and a crank chamber 96 which is defined between the front housing 16 and the cylinder block 10. The supply passage 94 is connected to a solenoid-operated control valve 100 provided to control the pressure in the crank chamber 96. The solenoid-operated control valve 100 includes a solenoid coil 102, and a shut-off valve 104 which is selectively closed and opened by energization and de-energization of the solenoid coil 102. Namely, the shut-off valve 104 is placed in its closed state when the solenoid coil 102 is energized, and is placed in its open state when the coil 102 is de-energized.

The rotary drive shaft 50 has a bleeding passage 110 formed therethrough The bleeding passage 110 is open at one of its opposite ends to the central bearing hole 56, and is open to the crank chamber 96 at the other end. The central bearing hole 56 communicates at its bottom with the suction chamber 22 through a communication port 114.

When the solenoid coil 102 of the solenoid-operated control valve 100 is energized, the supply passage 94 is closed, so that the pressurized refrigerant gas in the discharge chamber 24 is not delivered into the crank chamber 96. In this condition, the refrigerant gas in the crank chamber 96 flows into the suction chamber 22 through the bleeding passage 110 and the communication port 114, so that the pressure in the crank chamber 96 is lowered, to thereby increase the angle of inclination of the swash plate 60 with respect to a plane perpendicular to the axis M of rotation of the drive shaft 50. The reciprocating stroke of the piston 14 which is reciprocated by rotation of the swash plate 60 increases with an increase of the angle of inclination of the swash plate 60, so as to increase an amount of change of the volume of the pressurizing chamber 79, whereby the discharge capacity of the compressor is increased. When the solenoid coil 102 is de-energized, the supply passage 94 is opened, permitting the pressurized refrigerant gas to be delivered from the discharge chamber 24 into the crank chamber 96, resulting in an increase in the pressure in the crank chamber 96, and the angle of inclination of the swash plate 60 is reduced, so that the discharge capacity of the compressor is accordingly reduced.

The maximum angle of inclination of the swash plate 60 is limited by abutting contact of a stop 62 formed on the swash plate 60, with the rotary member 62, while the minimum angle of inclination of the swash plate 60 is limited by abutting contact of the swash plate 60 with a stop 122 in the form of a ring fixedly fitted on the drive shaft 50.

As described above, the pressure in the crank chamber 96 is controlled by controlling the solenoid-operated control valve 100 to selectively connect and disconnect the crank chamber 96 to and from the discharge chamber 24. By controlling the pressure in the crank chamber 96 by utilizing a difference between the pressure in the discharge chamber 24 as a high-pressure source and the pressure in the suction chamber 22 as a low pressure source, a difference between the pressure in the crank chamber 96 which acts on the front sides of the piston 14 and the pressure in the pressurizing chamber 79 is regulated to change the angle of inclination of the swash plate 60 with respect to a plane perpendicular to the axis M of rotation of the drive shaft 50, for thereby changing the reciprocating stroke (suction and compression strokes) of the piston 14, whereby the discharge capacity of the compressor can be adjusted.

The solenoid coil 102 of the solenoid-operated control valve 100 is controlled by a control device not shown depending upon a load acting on the air conditioning system including the present compressor. The control device is principally constituted by a computer. The swash plate type compressor of the present embodiment is variable capacity type In the present embodiment, the supply passage 94, the crank chamber 96, the solenoid-operated control valve 100, the bleeding passage 110, the communication port 114, and the control device for the control valve 100 cooperate to constitute a major portion of an angle adjusting device for controlling the angle of inclination of the swash plate 60 depending upon the pressure in the crank chamber 86.

The cylinder block 10 and each piston 14 are formed of an aluminum alloy. The piston 14 is coated at its outer circumferential surface with a fluoro resin film which prevents a direct contact of the aluminum alloy of the piston 14 with the aluminum alloy of the cylinder block 10, and makes it possible to minimize the amount of clearance between the piston 14 and the cylinder bore 12. The cylinder block 10 and the piston 14 may also be formed of an aluminum silicon alloy. Other materials may be used for the cylinder block 10, the piston 14, and the coating film.

There will next be described the configuration of the piston 14.

Figure 3:
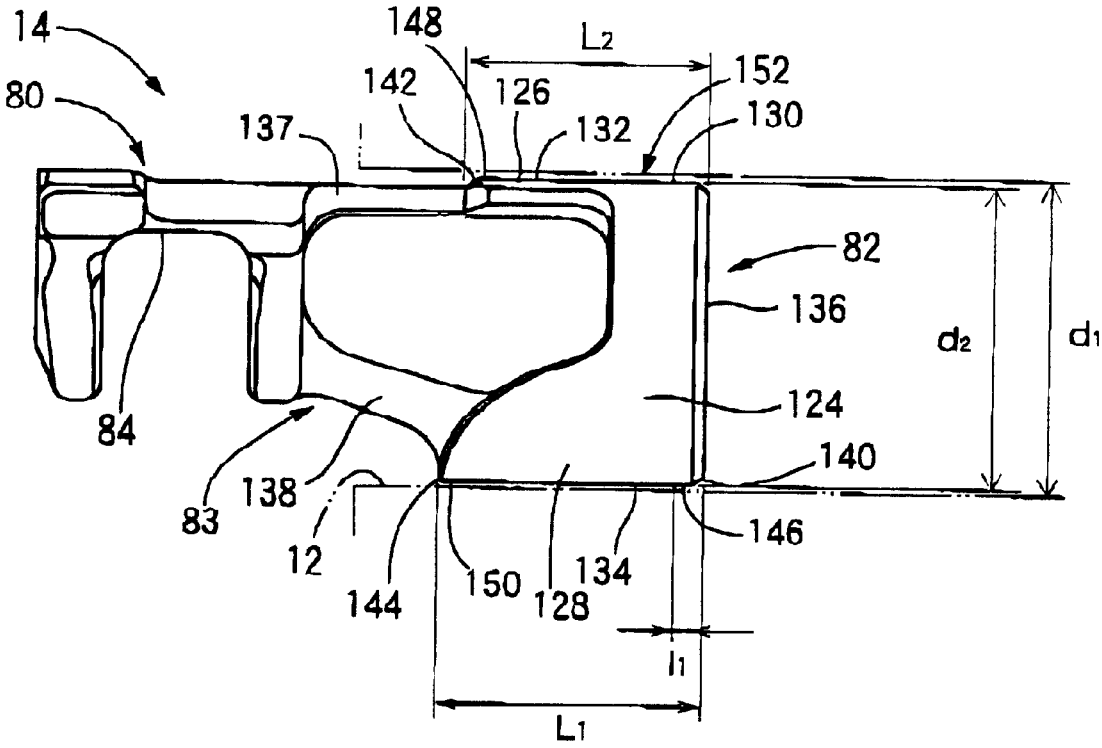
FIG. 3 is a front elevational view of the piston of FIG. 2.

As shown in FIGS. 2 and 3, the head portion 82 portion of the 14 includes a boby portion 124, an outer sliding portion 126 and an inner sliding portion 128 which correspond to respective radially outer and inner portions of the cylinder block 10. The radially outer portion of the cylinder block 10 is more distant from the centerline M than the radially inner portion of the cylinder block 10. The body portion 124 has a circular shape in cross section. The outer and inner sliding sections 126, 128 project towards the neck portion 80 from respective circumferential parts of the circular body portion 124, which parts correspond to the radially outer and inner portions of the cylinder block 10. An outer circumferential surface 130 of the body portion 124 and a part-circumferential surface 132 of the outer sliding section 126, and a part-circumferential surface 134 of the inner sliding section 128 are contiguous to or flush with one another. The outer and inner sliding sections 126, 128 are adapted to slide on the respective circumferential portions of the inner circumferential surface of the cylinder bore 12, which portions correspond to the radially outer and inner portions of the cylinder block 10. The connecting portion 83 of the piston 14 includes a rib 137 connecting the outer sliding section 126 and the neck portion 80, and a rib 138 connecting the inner sliding section 128 and the neck portion 80.

In the present embodiment, a total length L1 of the body portion 124 and the inner sliding section 138 (referred to as "head inner length which is a length of the head portion 82 as measured at the inner sliding section 138) is made larger than a total length L2 of the body portion 124 and the outer sliding section 137 (referred to as "outer head length", which is a length of the head portion 82 as measured at the outer sliding section 137). In other words, the length L1 from an end face 136 of the body portion 124 (which is remote from the neck portion 80) to the end of the inner sliding section 128 which is remote from the end face 136 is made larger than the length L2 from the end face 136 to the end of the outer sliding section 137. By increasing the length of the inner sliding section 128, the sliding surface pressure in the inner sliding section 128 at the end of the compression stroke of the piston can be lowered, resulting in an improved durability of the piston 14. Namely, the wear and the removal of the fluoro resin coating of the piston 14 can be prevented. However, an increase in the head inner length L1 will result in an increase in the weight of the piston 14. It is noted that the piston 14 has a given operating stroke. Therefore, the head inner length L1 is desirably determined with those factors taken into account. It is noted that the piston 14 may be formed by either joining together the head portion 82, neck portion 80 and connection portion 83 which have been formed as separate members, or forming these portions 82, 80, 83 integrally with each other.

As shown in FIG. 2, the configuration of the inner sliding section 128 in transverse cross section is not uniform in the axial direction. That is, the circumferential dimension of the inner sliding section 128 as represented by a central angle (between two lines which connect the centerline of the body portion 124 and circumferentially opposite ends of the inner sliding section 128 as seen in the circumferential direction of the body portion 124) is made smaller at a distal part of the inner sliding section 128 nearer to the neck portion 80 than at a proximal part nearer to the body portion 124. According to this arrangement, the amount of increase in the weight of the piston 14 can be made smaller than in an arrangement wherein these distal and proximal parts of the inner sliding section 128 have the same central angle or circumferential dimension. Although the sliding surface pressure of the inner sliding section 126 at its distal part decreases with an increase in the central angle, the weight of the piston 14 increases with the central angle. Therefore, the central angles at the distal and proximal parts of the inner sliding section 128 are desirably determined with those factors taken into account.

Figure 4:
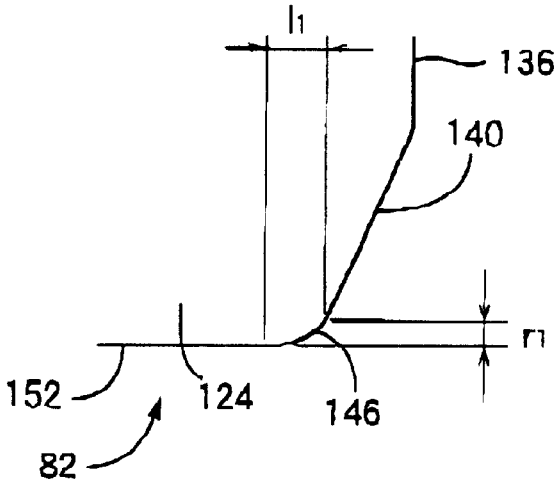
FIG. 4 is an enlarged front elevational view showing a portion of the piston of FIG. 2.

The respective outer circumferential surfaces 130, 132, 134 of the body portion 124, outer sliding portion 126, and inner sliding portion 128 cooperate with one another to provide a cylindrical surface 152 and curved surfaces 146, 148, 150. The curved surface 146 smoothly and continuously (in a mathematical sense) extends from one of the opposite axial ends of the cylindrical surface 152 while the curved surfaces 148, 150 smoothly and continuously extend from the other axial end. The expression "smoothly and continuously" is interpreted to mean a manner of connection of the curved surfaces 146, 148, 150 to the cylindrical surface 152 such that there is not any bend or any abrupt change of angle between the cylindrical surface 152 and the curved surfaces 146, 148, 150. The cylindrical surface 152 is part-cylindrical at its circumferential portions corresponding to the outer sliding portion 126 and the inner sliding portion 128, respectively. Chamfers 140, 142, 144 are formed at one of opposite ends of the respective curved surfaces 146, 148, 150 on the side remote from the cylindrical surface 152. As shown in an enlarged view of FIG. 4 which shows the curved surface 146 formed at one axial end of the cylindrical surface 152 on the side of the body portion 124, by way of example, the curved surface 146 is formed such that a radial distance between the curved surface 146 and the centerline of the cylindrical surface 162 gradually decreases in an axial direction of the cylindrical surface 162 from the corresponding axial end of the cylindrical surface 152 toward the end face 136, and such that a cross sectional shape of the curved surface 146 taken in a plane that includes the centerline of the cylindrical surface 152 is an arc having a constant radius of curvature. The radius of curvature of the arc is larger than the diameter of the inner circumferential surface of the cylinder bore 12, and is about 1000 mm in the present embodiment. The cylindrical surface 152, and the curved surfaces 146, 148, 150 cooperate with one another to provide an outer circumferential surface of the head portion 82 of the piston 14.

Each of the curved surfaces 146, 148, 150 is formed such that a quotient r1/l1 is substantially equal to a quotient r2/l2, wherein r1 is a dimension of each curved surface 146, 148, 150 between a surface of extension of the cylindrical surface 152 and a straight line which is parallel to the surface of extension and which passes one of opposite ends of each curved surface which is remote from the cylindrical surface 152, l1 is an axial dimension of each curved surface 146, 148, 150 as measured in a direction parallel to the centerline of the cylindrical surface 152, r2 is a clearance which is a difference between a diameter d1 of the inner circumferential surface of the cylinder bore 12 and a diameter d2 of the cylindrical surface 152 of the head portion 82 of the piston 14. This clearance will hereinafter be referred to as a "fitting clearance", and l2 is an axial dimension of the cylindrical surface 152.

In the present embodiment, the above-indicated axial dimension l2 of the cylindrical surface 152 is an axial distance between (1) a boundary between the cylindrical surface 152 and each curved surface 146, 148, 150 which contacts the inner circumferential surface of the cylinder bore 12 when the head portion 82 of the piston 14 is inclined within the cylinder bore 12 due to the side force applied from the swash plate 60 to the piston 14 in its radial direction, and (2) one of the opposite axial ends of the cylindrical surface 152 which is spaced from the above-indicated boundary in the diametric direction of the head portion 82 of the piston 14 and which is remote from the boundary in the axial direction of the head portion 82.

Figure 5A:
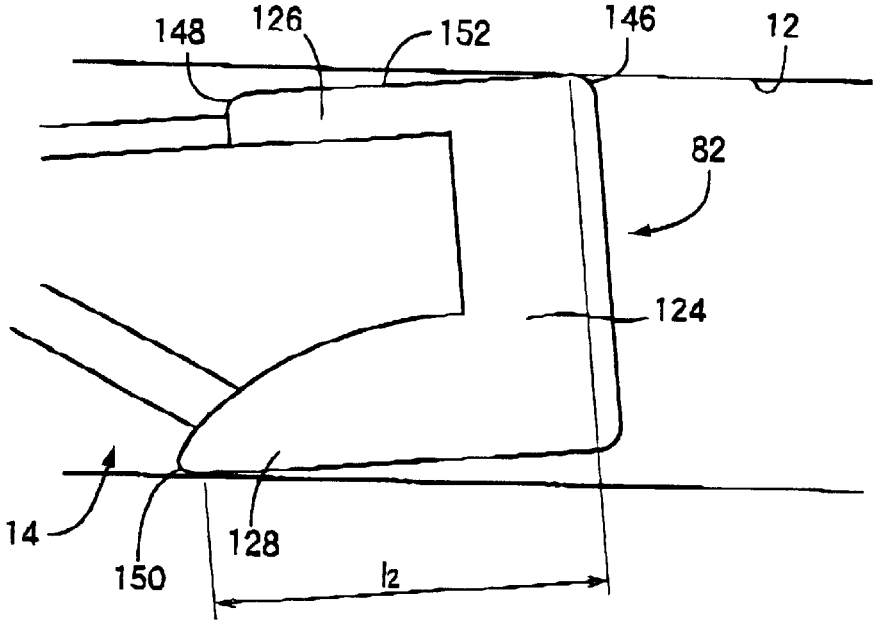
FIGS. 5A and 5B are views each showing the piston which is inclined within the cylinder bore of the cylinder block of the compressor.
Figure 5B:
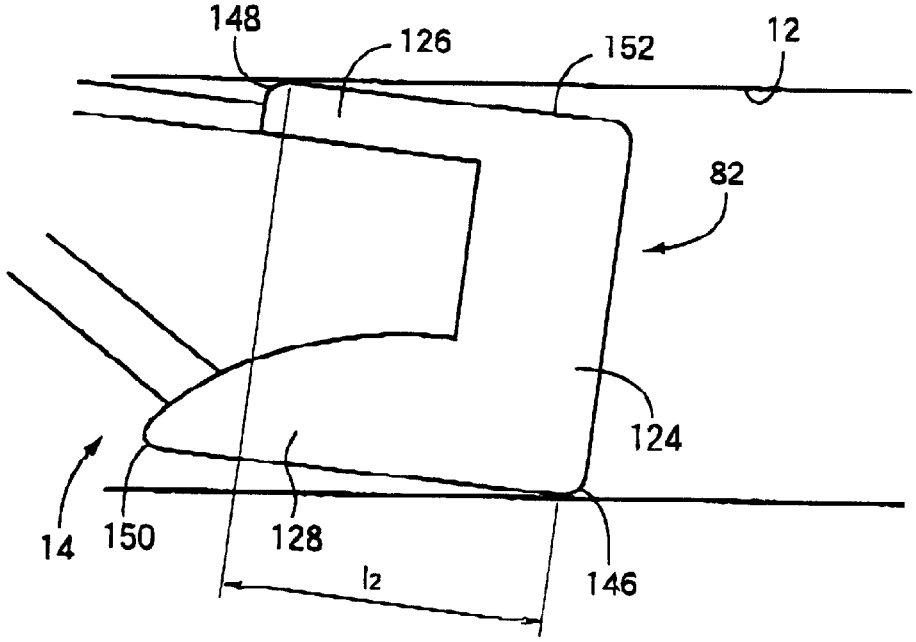

In the present embodiment wherein the head inner length L1 (i.e., the length of the head portion 82 as measured at the inner sliding section 128) is made larger than the head outer length L2 (i.e., the length of the head portion 82 as measured at the outer sliding section 126) as described above, the axial dimension l2 of the cylindrical surface 152 when the piston 14 is inclined within the cylinder bore 12 such that the axial end of the head portion 82 on the side of the end face 136 of the piston 14 (which partially defines the pressurizing chamber 79) contacts a radially outer portion of the inner circumferential surface of the cylinder bore 12, as shown in FIG. 5A, is different from that when the piston 14 is inclined within the cylinder bore 12 such that the above-indicated axial end of the head portion 82 contacts a radially inner portion of the inner circumferential surface of the cylinder bore 12, as shown in FIG. 5B. For easier understanding, only the head portion 82 of the piston 14 is schematically shown in FIGS. 5A and 5B without indicating the chamfers 140, 142, 144, and the inclination of the head portion 82 is exaggerated.

When the piston 14 is inclined within the cylinder bore 12 such that the axial end of the head portion 82 on the side of the end face 136 of the piston 14 contacts the radially outer portion of the inner circumferential surface of the cylinder bore 12, as shown in FIG. 5A, the axial dimension l2 of the cylindrical surface 152 is an axial distance between (1) a boundary between the cylindrical surface 152 and the curved surface 146 which is held in contact with the radially outer portion of the inner circumferential surface of the cylinder bore 12 of the cylinder block 10, and (2) a boundary between the cylindrical surface 152 and the curved surface 150 which is formed on the side of the inner sliding portion 128 and which is held in contact with the radially inner portion of the inner circumferential surface of the cylinder bore 12 of the cylinder block 10.

When the piston 14 is inclined within the cylinder bore 12 such that the above-indicated axial end of the head portion 82 contacts a radially inner portion of the inner circumferential surface of the cylinder bore 12, as shown in FIG. 5B, the axial dimension l2 of the cylindrical surface 152 is an axial distance between (1) a boundary between cylindrical surface 152 and the curved surface 146 which is held in contact with the radially inner portion of the inner circumferential surface of the cylinder bore 12, and (2) a boundary between the cylindrical surface 152 and the curved surface 148 which is formed on the side of the outer sliding portion 126 and which is held in contact with the radially outer portion of the inner circumferential surface of the cylinder bore 12.

Figure 6:
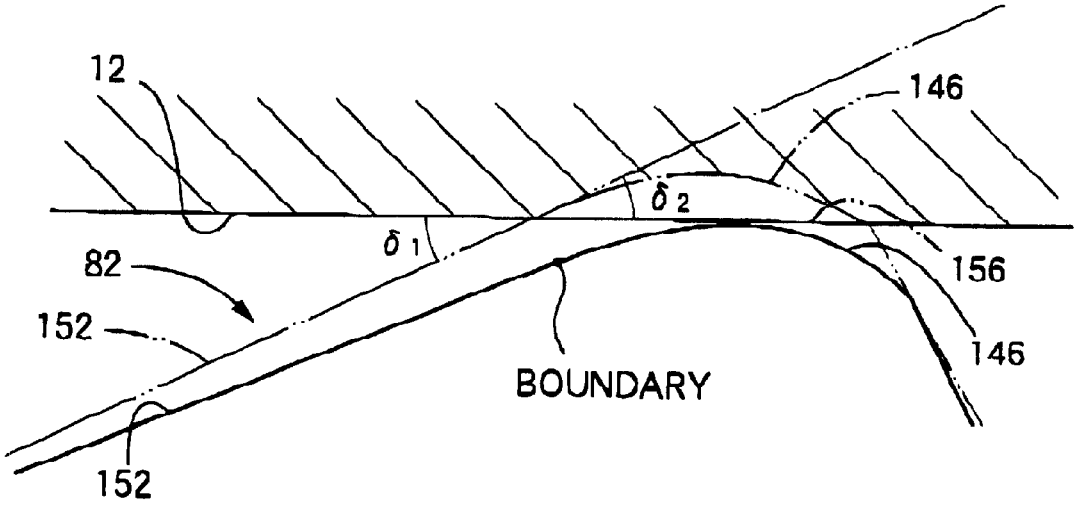
FIG. 6 is a fragmentary enlarged view in cross section showing the piston which contacts at its curved surface with the inner circumferential surface of the cylinder bore in FIG. 5A.

Referring next to FIG. 6, there will be described a significance of the quotient r1/l1 which is made substantially equal to the quotient r2/l2. FIG. 6 schematically shows a portion of the body portion 124 of the head portion 82 in an exaggerated manner. For easier understanding, there is established an imaginary tapered surface 156 (indicated by a two-dot chain line in FIG. 6) instead of the curved surface 146. The imaginary tapered surface 156 has the same dimensions r1 and l1 as the curved surface 146. The r2/l2 obtained by dividing the fitting clearance r2 by the axial dimension l2 of the cylindrical surface 152 is equal to an inclination angle 81 of the head portion 82 within the cylinder bore 12. The quotient r1/l1 obtained by dividing the dimension r1 of the imaginary tapered surface 156 (i.e., a dimension between the surface of extension of the cylindrical surface 152 and one of opposite ends of the imaginary tapered surface 156 which is remote from the cylindrical surface 152), by the axial dimension l1 of the imaginary tapered surface 156 (i.e., an axial dimension of the imaginary tapered surface 156 as measured in the direction parallel to the centerline of the cylindrical surface 152) is equal to an inclination angle 82 of the imaginary tapered surface 156 with respect to the surface of extension of the cylindrical surface 152. The fact that the inclination angles 81 and 82 are made equal to each other indicates that the imaginary tapered surface 156 is parallel to and held in close contact with the inner circumferential surface of the cylinder bore 12 when the head portion 82 of the piston 14 is inclined within the cylinder bore 12 at the angle 81. Actually, the curved surface 146 rather than the imaginary tapered surface 156 is brought into contact with the inner circumferential surface of the cylinder bore 12. The actual inclination angle of the head portion 82 indicated by a solid line in FIG. 6 is smaller than the angle of inclination of the head portion 82 as indicated by the two-dot chain line since the curved surface 146 is located radially outwardly of the imaginary tapered surface 156. Accordingly, the curved surface 146 is held in contact with the inner circumferential surface of the cylinder bore 12 at its axially intermediate portion, to thereby form a wedge-shaped gap between the curved surface 146 and the inner circumferential surface of the cylinder bore 12. The effect of the wedge-shaped gap will be described in greater detail. The above explanation is true for the curved surface 146 of the body portion 124 which is held in contact with the radially inner portion of the inner circumferential surface of the cylinder bore 12 of the cylinder block 10, and the curved surfaces 148, 150. It is desirable to determine the various dimensions described above such that each curved surface 146, 148, 150 is held in contact with the inner circumferential surface of the cylinder bore 12 at its axial portion which is nearer to the boundary between the cylindrical surface 152 and the end of the curved surface, than its axially intermediate portion. In the present embodiment, the dimension r1 of each curved surface 146, 148, 150 is in a range of 2–4 $\mu$m, while the axial dimension l1 of the curved surface is in a range of 1.8~2.8 mm. The axial dimension l1 is $1/8$~$1/13$ of the axial dimension l2 of the cylindrical surface 152. The wedge-shaped gap which is formed when the axially intermediate portion of each curved surface 146, 148, 150 is held in contact with the inner circumferential surface of the cylinder bore 12 as a result of inclination of the head portion 82 of the piston within the cylinder bore 12, has a dimension of 2~8 $\mu$m as measured in the direction of r1. In other words, the above-indicated dimension of the wedge-shaped gap is a distance between the inner circumferential surface of the cylinder bore 12 and one of opposite ends of each curved surface 146, 148, 150 which is remote from the cylindrical surface 152, which one end is a boundary between each curved surface 146, 148, 150 and the corresponding chamfer 140, 142, 144.

When the thus constructed piston 14 is used for the swash plate type compressor, it was confirmed by the following experiment that the noise of the compressor during its operation was reduced. In the experiment, there were used two variable capacity type swash plate compressors having seven cylinder bores in each of which a single-headed piston 14 having a diameter of 32 mm was fitted. The single-headed piston used for one of the swash plate type compressors does not have the curved surfaces as described above, whereas the single-headed piston 14 used for the other swash plate type compressor has the curved surfaces 146, 148, 150 according to the present invention. Under the same circulating condition of the refrigerant gas, the two swash plate type compressors were operated at 1000 rpm and at a discharge pressure of 1.5 Mpa, so that the levels of the noise generated by the two compressors were compared with each other. The comparison revealed that the noise generated by the swash plate type compressor which was equipped with the single-headed pistons having the curved surfaces 146, 148, 150 was smaller by 3–4 dB than that generated by the swash plate type compressor equipped with the single-headed pistons without the curved surfaces 146, 148, 150.

It is considered that the reduction of the noise in the swash plate type compressor equipped with the single-headed pistons having the curved surfaces 146, 148, 150 is owing to a reduced sliding resistance of the piston 14 during its reciprocating movement within the cylinder bore 12. When the head portion 82 of the piston 14 is slidably moved in the cylinder bore 12, the piston 14 is inclined in the cylinder bore 12 by a rotary moment based on the side force applied from the swash plate 60 to the piston 14. In the compression stroke of the piston 14, in particular, the circumferential portion of the body portion 124 which corresponds to the radially outer portion of the cylinder block 10, and the inner sliding portion 128 are brought into contact with the inner circumferential surface of the cylinder bore 12 at a large contacting pressure, as shown in FIG. 5A. In the present embodiment, the surface pressure of contact of the head portion 82 of the piston 14 with the inner circumferential surface of the cylinder bore 12 is reduced owing to the curved surfaces 146, 148, 150. Namely, the head portion 82 of the piston 14 is dimensioned such that the head portion 82 is brought into contact with the inner circumferential surface of the cylinder bore 12 at the curved surfaces 146, 158, 150 when the head portion 82 of the piston 14 is inclined in the cylinder bore 12, so that the surface pressure of contact with the head portion 82 of the piston 14 with the inner circumferential surface of the cylinder bore 12 is reduced. If the outer circumferential surface of the head portion 82 were a complete cylindrical surface without the curved surfaces 146, 148, 150 provided according to the present invention, the head portion 82 would be pressed at its periphery onto the inner circumferential surface of the cylinder bore 12 at a large contacting pressure even when the piston 14 is slightly inclined. In this case, a film of a lubricant oil adhering to the inner circumferential surface of the cylinder bore 12 is undesirably scraped off by the peripheral edge of the head portion 82, causing seizure between the head portion 82 and the inner circumferential surface of the cylinder bore 12. In contrast, the piston 14 of the present invention having the curved surfaces 146, 148, 150 does not suffer from such a problem, owing to a reduced sliding resistance of the piston 14. In the present embodiment, the curved surfaces 146, 148, 160 and the inner circumferential surface of the cylinder bore 12 cooperate with one another to form the wedge-shaped gap therebetween such that an angle between the inner circumferential surface of the cylinder bore 12 and each curved surface 146, 148, 150 smoothly decreases in a direction toward the contact point of each curved surface 146, 148, 150 with the inner circumferential surface of the cylinder bore 12. Accordingly, when the piston 14 is slidably moved in the cylinder bore 12, the lubricant oil adhering to the inner circumferential surface of the cylinder bore 12 and the lubricant oil dispersed in the form of a mist in the refrigerant gas is introduced into the wedge-shaped gap, with a result of formation of an oil film between the curved surfaces 146, 148, 150 and the inner circumferential surface of the cylinder bore 12, permitting fluid lubrication to prevent a direct contact of the curved surfaces 146, 148, 150 and the inner circumferential surface of the cylinder bore 12. Accordingly, the piston 14 can be smoothly moved in the cylinder bore 12 since the piston 14 is prevented from directly contacting the inner circumferential surface of the cylinder bore 12, or the contacting surface pressure therebetween is reduced.

When the piston 14 suffers from a rotary moment as shown in FIG. 5A, the piston 14 is permitted to rotate by a small angle. With this rotation of the piston 14, the curved surfaces 146, 148, 150 approach the inner circumferential surface of the cylinder bore 12, and the size of the wedge-shaped gap formed therebetween is reduced. Since the size of the wedge-shaped gap is small enough to inhibit the lubricant oil from flowing out of the gap, there is generated a relatively high pressure of the oil film between the curved surfaces 146, 148. 150 and the inner circumferential surfaces of the cylinder bore 12 when the piston 14 is rotated. The high pressure of the oil film is effective to prevent further inclination of the piston 14. In particular when the piston 14 is moved toward its upper dead point (in the rightward direction as seen in FIG. 5A) while the piston 14 is inclined, a relatively large oil pressure is generated between the curved surface 146 and the inner circumferential surface of the cylinder bore 12 owing to a wedge effect, so that the curved surface 146 is pressed away from the inner circumferential surface of the cylinder bore 12 by the high oil pressure. Accordingly, the aluminum alloy of the piston 14 is prevented from directly contacting the aluminum alloy of the cylinder block 10, thereby reducing the sliding resistance of the head portion 82 of the piston 14 in the cylinder bore 12.

In the present swash plate type compressor wherein the inclination of the piston 14 in the cylinder bore 12 is restricted or limited and the piston 14 is smoothly movable in the cylinder bore 12, local wearing and removal of the fluoro resin coating on the outer circumferential surface of the head portion 82 of the piston 14 can be minimized.

Since the end face of the body portion 124 partially defining the pressurizing chamber 79 has a simple circular configuration, the curved surface 146 can be easily formed over the entire circumference of the end face of the body portion 82.

In the present embodiment, the body portion 124 provides a sealing portion, and the outer circumferential surfaces 132, 134 of the outer and inner sliding portions 126, 128 provide auxiliary sliding surfaces. The curved surfaces may be formed only at the circumferential part of the body portion 124 corresponding to the radially outer portion of the cylinder block 10, and at the inner sliding portion 128, in view of the fact that the above-indicated circumferential part of the body portion 124 and the inner sliding portion 128 tend to be held in a pressing contact with the inner circumferential surface of the cylinder bore 12 in the compression stroke of the piston 14 due to the side force applied from the swash plate 60 to the piston 14. Alternatively, the curved surface may be formed at the outer circumferential surface of the end portion of at least one of the body portion 124, inner sliding portion 128 and outer sliding portion 126. Further, the curved surface may be formed at only a part of the outer circumferential surface of each of those portions 124, 128, 126, which part is held in contact with the inner circumferential surface of the cylinder bore 12, or only at the above-indicated part contacting the inner circumferential surface of the cylinder bore 12 and a portion adjacent thereto.

The cross sectional shape of the curved surface is not limited to an arcuate shape having a constant radius of curvature in the present embodiment, but may be any other configuration having a smooth convex curve. For instance, the cross sectional shape of the curved surface may be constituted by a plurality of arcs whose radii of curvature gradually decrease in a longitudinal direction of the piston 14 away from the cylindrical surface.

Figure 7:
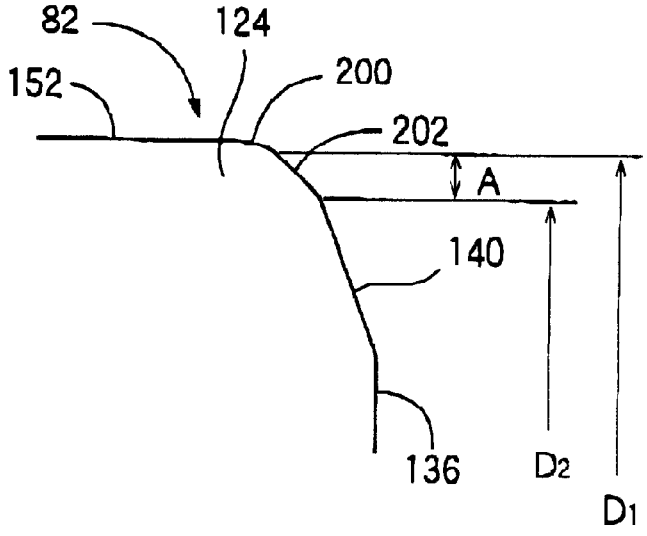
FIG. 7 is an enlarged front elevational view showing a portion of a piston constructed according to another embodiment of the present invention.

Referring next to FIG. 7, there is shown a piston constructed according to another embodiment, wherein the outer circumferential surface of the head portion 82 of the piston is shaped differently from that of the piston in the preceding embodiment of FIGS. 1–6. In FIG. 7, the same reference numerals as used in the embodiment of FIGS. 1–6 are used to identify the corresponding components, and a detailed explanation of which is dispensed with. As shown in FIG. 7, the outer circumferential surface of the head portion 82 on the side of the body portion 124 includes the cylindrical surface 152, a curved surface 200 which smoothly and continuously (in a mathematical sense) extends from the cylindrical surface 152, and a tapered surface 202 which smoothly and continuously extends from one of opposite ends of the curved surface 200 on the side remote from the cylindrical surface 152. The expression "smoothly and continuously" is interpreted in the same manner as explained above with respect to the cylindrical surface 152 and the curved surfaces 146, 148, 150. The curved surface 200 and the tapered surface 202 are formed over the entire circumference of the body proton 124. In FIG. 7, a circumferential portion of the body portion 124 which corresponds to the radially outer portion of the cylinder block 10 is shown. Like the curved surface 146 in the preceding embodiment of FIGS. 1–6, the curved surface 200 of this embodiment is formed such that a radial distance from the centerline of the cylindrical surface 152 gradually decreases in a longitudinal direction of the piston 14 away from the cylindrical surface 152, and such that the cross sectional shape of the curved surface 200 taken in a plane which includes the centerline of the cylindrical surface 152 is an arc having a constant radius of curvature. The tapered surface 202 has a diameter which linearly decreases in the axial direction of the cylindrical surface 152 from the curved surface 200 toward the end face 136. The chamfer 140 is formed adjacent to at one of opposite ends of the tapered surface 202 which is remote from the curved surface 200. The taper angle of the tapered surface 202 is smaller than that of the chamfer 140. The tapered surface 202 is formed such that a difference A (FIG. 7) between a radius of its large-diameter end and a radius of its small-diameter end is preferably in a range of 1 $\mu$m~15 $\mu$m. Owing to a wedge effect of a wedge-shaped gap formed between the tapered surface 202 and the inner circumferential surface of the cylinder bore 12, the lubricant oil adhering to the inner circumferential surface of the cylinder bore 12 and the mist-form lubricant oil dispersed in the refrigerant gas is effectively introduced into the wedge-shaped gap. As for the outer circumferential surfaces of the outer and inner sliding portions 126, 128, the tapered surface may be formed so as to smoothly extend from one of opposite ends of the curved surface 200 as described above. When the head portion 82 of the piston 14 is adapted to be held in contact with the inner circumferential surface of the cylinder bore 12 at its curved surface 200 as in the preceding embodiment, the contacting surface pressure therebetween can be reduced. Accordingly, the head portion 82 of the piston 14 is prevented from contacting directly the inner circumferential surface of the cylinder bore 12, or the contacting surface pressure between the outer circumferential surface of the head portion 82 and the inner circumferential surface of the cylinder bore 12 is reduced, so that the sliding resistance of the piston 14 is reduced.

The outer circumferential surface of the head portion 82 may consist of a cylindrical surface and a tapered surface which extends from one of opposite ends of the cylindrical surface. Like the tapered surface 202 of FIG. 7, this tapered surface has a diameter which linearly decreases in the axial direction of the cylindrical surface 152 from this surface 152 toward the axial end face 136. The taper angle of this tapered surface is smaller than that of the chamber formed adjacent thereto. The tapered surface is formed such that a difference between a radius of its large-diameter end and a radius of its small-diameter end is preferably in a range of 1~15 $\mu$m. The operating noise generated by the compressor is reduced owing to the wedge effect formed between the tapered surface and the inner circumferential surface of the cylinder bore. For advantageously enjoying the wedge effect, the dimensions of the cylindrical surface, the tapered surface, and the clearance with respect to the cylinder bore 12 are preferably determined such that such that the wedge-shaped gap has a dimension of 1~5 $\mu$m even when the head portion 82 of the piston is inclined in the cylinder bore 12 to a maximum extent. The above-indicated dimension of the wedge-shaped gap is a distance between the small-diameter end of the tapered surface and the inner circumferential surface of the cylinder bore 12.

The configuration of the piston 14 is not particularly limited to that of the illustrated embodiment. For instance, the connection portion 83 need not include both of the ribs 137, 138, but may consist of only one of these two ribs 137, 138. Similarly, the configuration and size of the distal sliding part of each of the outer and inner sliding portions 126, 128 (which is on the side of the neck portion 80) are not limited to the details described above with respect to the illustrated embodiment. The distal sliding part of each outer and inner sliding portions 126, 128 may have any configuration and size, provided that the configuration and size assure an improvement in the durability of the piston 14. For instance, the distal sliding part of the inner sliding portion 128 may have a circumferential dimension and a center angle (between two straight lines which connect the centerline of the body portion 124 and circumferentially opposite ends of the inner sliding section 128 as seen in the circumferential direction of the body portion 124) which continuously and smoothly decrease as the distal sliding part of the inner sliding portion 128 extends in the longitudinal direction of the piston 14 from the body portion 124 toward the neck portion 80. In this case, the curved surface 150 may be formed so as to entirely extend between the appropriate end of the cylindrical surface 152 and the chamfer 144. Alternatively, the curved surface 150 may be formed so as to partially extend between the cylindrical surface 152 and the chamfer 144, i.e., at a portion which contacts the inner circumferential surface of the cylinder bore 12. The configurations of the outer and inner sliding portions 126, 128 may be either symmetrical or asymmetrical with respect to a plane which passes the centerline N of the piston 14 and the centerline M of the cylinder block 10. The piston 14 may have various other configurations, such as a configuration as disclosed in Japanese Patent Application No. 11-150448 filed by the assignee of the present invention.

The pistons of the illustrated embodiments has a through-hole formed through its circumferentially intermediate portion, for thereby reducing the weight of the piston. In this respect, it is noted that the outer circumferential surface of head portion of the piston suffers from a particularly high sliding surface pressure at its circumferential parts corresponding to the respective radially outer and inner portions of the cylinder block 10, and that the other circumferential parts (between the outer and inner sliding portions 137, 138) do not suffer from a high sliding surface pressure. Accordingly, the through-hole can be formed at the circumferentially intermediate portion of the piston to reduce its weight.

Figure 8:
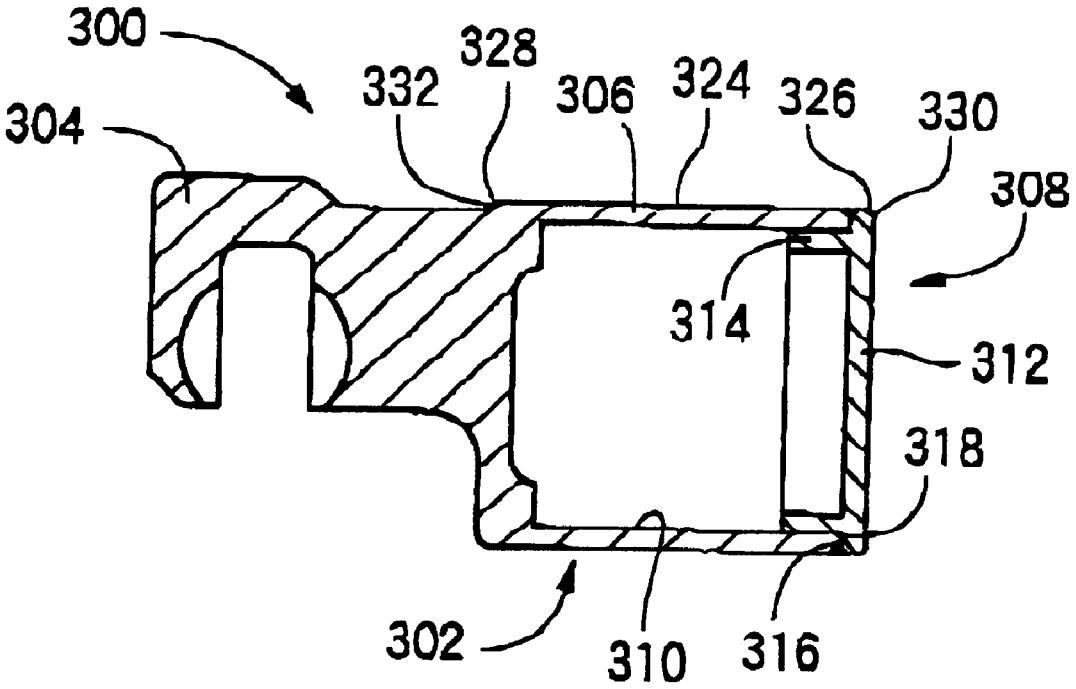
FIG. 8 is a front elevational view showing a single-headed piston constructed according to still another embodiment of the present invention.

The weight of the piston can be reduced by forming the piston with a hollow cylindrical head portion. FIG. 8 shows a single-headed piston 300 constructed according to another embodiment of the invention. The structure of the swash plate type compressor which uses the piston 300 is the same as that of the compressor in the embodiment of FIGS. 1–6, and a detailed explanation of which is dispensed with. The piston 300 includes a head portion 302 and an engaging portion in the form of a neck portion 304 which is integrally formed with the head portion 302. The head portion 302 includes a hollow cylindrical body portion 306 which has an open end on the side remote from the neck portion 304, and a closure member 308 which is fixed to the body portion 306 and which closes the open end of the body portion 306. The head portion 306 has an inner circumferential surface 310 having a constant diameter over the entire axial length thereof. The closure member 308 includes a circular plate portion 312, and an annular fitting protrusion 314 which protrudes from an inner end face of the plate portion 312 and which has a diameter smaller than the circular plate portion 312. A shoulder 316 is formed between the circular plate portion 312 and the annular fitting protrusion 314. The closure member 308 is fitted in the body portion 306 such that the fitting protrusion 314 of the closure member 308 engages the inner circumferential surface 310 of the body portion 306, and such that the shoulder 316 of the closure member 308 is held in abutting contact with an end face 318 of the body portion 306 at its open end. With the closure member 308 being fitted in the body portion 306, these two members are fixed to each other by welding, for instance.

The outer circumferential surface of the head portion 302 of the piston 300 includes a cylindrical surface 324, and curved surfaces 326, 328 which smoothly extend from the axially opposite ends of the cylindrical surface 324, respectively. Chamfers 330, 332 are formed at one of opposite ends of the respective curved surfaces 326, 328, which end is remote from the cylindrical surface 324. Each of the curved surfaces 326, 328 is formed such that a radial distance from the centerline of the cylindrical surface 324 gradually decreases in a direction away from the cylindrical surface 324, and such that the cross sectional shape of each curved surface 326, 328 cut along a plane which includes the centerline of the cylindrical surface 324 is an arc having a constant radius of curvature. The curved surfaces 326, 328 are formed over the entire circumference at opposite ends of the body portion 306, respectively. The dimensions and the configurations of the curved surfaces 326, 328 are the same as those of the curved surfaces 146, 148, 150 of the preceding embodiment, and a detailed explanation of which is dispensed with. In the present embodiment, however, the axial dimension 12 of the cylindrical surface 324 when the head portion 302 of the piston 300 is inclined in the cylinder bore 12 toward the radially outer portion of the cylinder block 10, is not different from that when the head portion 302 is inclined in the cylinder bore 12 toward the radially inner portion of the cylinder block 10. The dimensions of the curved surfaces 326. 328 are determined with the above-indicated fact taken into account, As in the swash plate type compressor equipped with the piston 14 according to the preceding embodiment, the sliding resistance of the piston 300 of the present embodiment during its reciprocating movement in the cylinder bore 12 can be reduced, and the operation noise of the compressor can be reduced. Owing to the curved surface 328 formed at one of the opposite ends of the head portion 302, which end is on the side of the neck portion 304, the contacting surface pressure between the head portion 302 of the piston 300 and the inner circumferential surface of the cylinder bore 12 when the piston 300 is inclined in the cylinder bore 12 can be reduced, so that the piston 300 exhibits an excellent durability. Since the opposite ends of the cylindrical surface of the head portion 302 has a simple circular configuration, it is easy to form the curved surfaces 326, 328 over the entire circumference at the opposite ends of the head portion 302. As in the preceding embodiment shown in FIGS. 1–6, the curved surface may be formed at only one of opposite axial ends of the head portion 302. Further, the curved surface may be formed at a selected circumferential part of the opposite ends of the head portion 302 without extending over the entire circumference. A tapered surface similar to the tapered surface 202 of FIG. 7 may be formed so as to smoothly extend from each curved surface 326, 328. The curved surfaces 326, 328 may have any cross sectional shape which has a smooth convex curve.

The construction of the swash plate type compressor for which the pistons 14, 300 are incorporated is not limited to that of FIG. 1. For instance, the solenoid-operated control valve 100 is not essential, and the compressor may use a shut-off valve which is mechanically opened and closed depending upon a difference between the pressures in the crank chamber 96 and the discharge chamber 24. In place of or in addition to the solenoid-operated control valve 100, a solenoid-operated control valve similar to the control valve 100 may be provided in the bleeding passage 110. Alternatively, a shut-off valve may be provided, which is mechanically opened or closed depending upon a difference between the pressures in the crank chamber 96 and the suction chamber 22. The pistons of the present invention may be used for a fixed capacity type swash plate compressor wherein the angle of inclination of the swash plate is fixed.

While some presently preferred embodiments of this invention have been described above, for illustrative purpose only, it is to be understood that the present invention may be embodied with various changes and improvements such as those described in the SUMMARY OF THE INVENTION, which may occur to those skilled in the art.

What is claimed is:

1. A single-headed piston for a swash plate type compressor including a head portion having an outer circumferential surface for sliding contact with an inner circumferential surface of a cylinder bore formed in a cylinder block of the compressor, and an engaging portion engaging a swash plate of the compressor, wherein said outer circumferential surface of said head portion includes a cylindrical surface and a curved surface which is formed adjacent to at least one of opposite axial ends of said cylindrical surface, so as to smoothly extend from at least one circumferential part of said cylindrical surface, said curved surface being formed such that a radial distance between a centerline of said cylindrical surface and said curved surface gradually decreases in an axial direction of said cylindrical surface from the corresponding axial end of said cylindrical surface toward the corresponding axial end of said piston, and such that a radius of curvature of a cross sectional shape of said curved surface taken in a plane which includes said centerline of said cylindrical surface is larger than a diameter of said inner circumferential surface of said cylinder bore, and a dimension (r1) between a surface of extension of said cylindrical surface and a straight line which is parallel to said surface of extension and which passes one of opposite ends of said curved surface which is remote from said cylindrical surface is not greater than 15 $\mu$m.

2. A swash plate type compressor comprising:

a housing having a plurality of cylinder bores, a rotary drive shaft which is rotatably supported by said housing, a swash plate which is prevented from rotating relative to said rotary drive shaft and which is inclined with respect to an axis of said rotary drive shaft; and a piston including a head portion slidably fitted in each of said cylinder bores, and an engaging portion slidably engaging said swash plate through a pair of shoes which are held in contact with opposite surfaces of said swash plate at a radially outer portion of said swash plate, and wherein said piston has a structure as defined in claim 1.

3. A swash plate type compressor according to claim 2, further comprising a swash plate angle adjusting device for adjusting an angle of inclination of said swash plate with respect to said axis of said rotary drive shaft.

4. A single-headed piston for a swash plate type compressor including a head portion having an outer circumferential surface for sliding contact with an inner circumferential surface of a cylinder bore formed in a cylinder block of the compressor, and an engaging portion engaging a swash plate of the compressor, wherein said outer circumferential surface of said head portion includes a cylindrical surface and a curved surface which is formed adjacent to at least one of opposite axial ends of said cylindrical surface, so as to smoothly extend from at least one circumferential part of said cylindrical surface, said curved surface being formed such that a radial distance between a centerline of said cylindrical surface and said curved surface gradually decreases in an axial direction of said cylindrical surface from the corresponding axial end of said cylindrical surface toward the corresponding axial end of said piston, and such that a radius of curvature of a cross sectional shape of said curved surface taken in a plane which includes said centerline of said cylindrical surface is larger than a diameter of said inner circumferential surface of said cylinder bore, and a quotient obtained by dividing a dimension (r1) between a surface of extension of said cylindrical surface and said straight line which is parallel to said surface of extension and which passes one of opposite ends of said curved surface which is remote from said cylindrical surface, by an axial dimension (l1) of said curved surface as measured in a direction parallel to said centerline of said cylindrical surface, is substantially equal to a quotient obtained by dividing a clearance (r2) between said outer circumferential surface of said head portion of the piston and said inner circumferential surface of said cylinder bore when the piston is fitted in said cylinder bore, by an axial dimension (l2) of said cylindrical surface, said clearance (r2) being a difference between a diameter of said outer circumferential surface of said head portion and said diameter of said inner circumferential surface of said cylinder bore.

5. A single-headed piston according to claim 1, wherein said axial dimension (l1) of said curved surface which is parallel to its centerline is not larger than ⅕ of said axial dimension (l2) of said cylindrical surface.

6. A swash plate type compressor comprising:

a housing having a plurality of cylinder bores, a rotary drive shaft which is rotatably supported by said housing, a swash plate which is prevented from rotating relative to said rotary drive shaft and which is inclined with respect to an axis of said rotary drive shaft; and a piston including a head portion slidably fitted in each of said cylinder bores, and an engaging portion slidably engaging said swash plate through a pair of shoes which are held in contact with opposite surfaces of said swash plate at a radially outer portion of said swash plate, and wherein said piston has a structure as defined in claim 4.

7. A swash plate type compressor according to claim 6, further comprising a swash plate angle adjusting device for adjusting an angle of inclination of said swash plate with respect to said axis of said rotary drive shaft.

8. A single-headed piston for a swash plate type compressor including a head portion having an outer circumferential surface for sliding contact with an inner circumferential surface of a cylinder bore formed in a cylinder block of the compressor, and an engaging portion engaging a swash plate of the compressor, wherein said outer circumferential surface of said head portion includes a cylindrical surface and a curved surface-which is formed adjacent to at least one of opposite axial ends of said cylindrical surface, so as to smoothly extend from at least one circumferential part of said cylindrical surface, said curved surface being formed such that a radial distance between a centerline of said cylindrical surface and said curved surface gradually decreases in an axial direction of said cylindrical surface from the corresponding axial end of said cylindrical surface toward the corresponding axial end of said piston, and such that a radius of curvature of a cross sectional shape of said curved surface taken in a plane which includes said centerline of said cylindrical surface is larger than a diameter of said inner circumferential surface of said cylinder bore, and said outer circumferential surface of said head portion includes a tapered surface which smoothly extends from one of opposite ends of said curved surface which is remote from said cylindrical surface such that said tapered surface has a diameter which gradually and linearly reduces in an axial direction of said cylindrical surface from said curved surface toward the corresponding axial end of said piston, said tapered surface being formed such that a difference between a radius of its large-diameter end and a radius of its small-diameter end is selected within a range between 1 $\mu$m and 15 $\mu$m.

9. A swash plate type compressor comprising:

a housing having a plurality of cylinder bores, a rotary drive shaft which is rotatably supported by said housing, a swash plate which is prevented from rotating relative to said rotary drive shaft and which is inclined with respect to an axis of said rotary drive shaft; and a piston including a head portion slidably fitted in each of said cylinder bores, and an engaging portion slidably engaging said swash plate through a pair of shoes which are held in contact with opposite surfaces of said swash plate at a radially outer portion of said swash plate, and wherein said piston has a structure as defined in claim 8.

10. A swash plate type compressor according to claim 9, further comprising a swash plate angle adjusting device for adjusting an angle of inclination of said swash plate with respect to said axis of said rotary drive shaft.

11. A single-headed piston for a swash plate type compressor including a head portion having an outer circumferential surface for sliding contact with an inner circumferential surface of a cylinder bore formed in a cylinder block of the compressor, and an engaging portion engaging a swash plate of the compressor, characterized in that; said outer circumferential surface of said head portion includes a cylindrical surface, and a tapered surface which is formed adjacent to at least one of axially opposite ends of said cylindrical surface so as to extend from at least one circumferential part of said cylindrical surface, said tapered surface being formed such that a difference between a radius of its large-diameter end and a radius of its small-diameter end is selected within a range between 1 $\mu$m and 15 $\mu$m.

12. A single-headed piston for a swash plate type compressor including a head portion having an outer circumferential surface for sliding contact with an inner circumferential surface of a cylinder bore formed in a cylinder block of the compressor, and an engaging portion engaging a swash plate of the compressor, wherein said outer circumferential surface of said head portion includes a cylindrical surface and a curved surface which is formed adjacent to at least one of opposite axial ends of said cylindrical surface, so as to smoothly extend from at least one circumferential part of said cylindrical surface, said curved surface being formed such that a radial distance between a centerline of said cylindrical surface and said curved surface gradually decreases in an axial direction of said cylindrical surface from the corresponding axial end of said cylindrical surface toward the corresponding axial end of said piston, and such that a radius of curvature of a cross sectional shape of said curved surface taken in a plane which includes said centerline of said cylindrical surface is larger than a diameter of said inner circumferential surface of said cylinder bore, and said head portion of the piston includes a sealing section having a circular cross sectional shape, and two auxiliary sliding surfaces which are located between said engaging portion of the piston and said sealing section and which consist of an inner auxiliary sliding surface which is nearer to an axis of rotation of said swash plate, and an outer auxiliary sliding surface which is remote from the axis of rotation of said swash plate, said two auxiliary sliding surfaces are flush with an outer circumferential surface of said sealing section.

* * * * *